US007395839B2

(12) United States Patent
Debaes

(10) Patent No.: US 7,395,839 B2
(45) Date of Patent: Jul. 8, 2008

(54) METHOD FOR MANUFACTURING HIGH DENSITY PILE FABRICS

(75) Inventor: Johny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 11/634,510

(22) Filed: Dec. 6, 2006

(65) Prior Publication Data

US 2007/0125440 A1 Jun. 7, 2007

(30) Foreign Application Priority Data

Dec. 6, 2005 (BE) ..... 2005/0591

(51) Int. Cl.

| | |
|---|---|
| ***D03D 39/16*** | (2006.01) |
| ***D03D 39/18*** | (2006.01) |
| ***D03D 47/12*** | (2006.01) |
| *D03D 39/10* | (2006.01) |
| *D03D 47/27* | (2006.01) |

(52) U.S. Cl. ..... 139/21; 139/116.5; 139/443; 139/446; 139/37; 139/47

(58) Field of Classification Search ..... 139/21, 139/37–47, 102, 116.5, 438, 439, 443, 446
See application file for complete search history.

(56) References Cited

U.S. PATENT DOCUMENTS

| | | | | |
|---|---|---|---|---|
| 5,465,761 A | | 11/1995 | Gheysen | |
| 5,522,435 A | * | 6/1996 | DeRudder | 139/65 |
| 5,615,712 A | * | 4/1997 | Derudder et al. | 139/21 |
| 5,655,573 A | * | 8/1997 | Gheysen et al. | 139/21 |
| 6,092,562 A | * | 7/2000 | Debaes | 139/398 |
| 6,102,083 A | * | 8/2000 | Vandoorne | 139/391 |
| 6,173,746 B1 | * | 1/2001 | Debaes et al. | 139/392 |

(Continued)

FOREIGN PATENT DOCUMENTS

| | | |
|---|---|---|
| EP | 1013804 | 6/2000 |

(Continued)

*Primary Examiner*—Robert H. Muromoto
(74) *Attorney, Agent, or Firm*—James Creighton Wray; Clifford D. Hyra

(57) ABSTRACT

The present invention relates to a method for face-to-face weaving of a pile fabric on a weaving machine, pile forming pile warp yarns (6, 7, 8, 9, 16, 17, 18, 19) being interlaced alternately around a weft yarn (1) in the upper fabric and around a weft yarn (1) in the lower fabric and non pile forming pile warp yarns (6, 7, 8, 9, 16, 17, 18, 19) being interlaced in one of the backing fabrics in accordance with a predetermined pattern, the said weaving machine comprising at least three weft insertion means and that at each weft insertion cycle only one weft yarn is inserted, the non pile forming pile warp yarns (6, 7, 8, 9, 16, 17, 18, 19) to be interlaced are positioned on a different level (N1, N2) and, in successive series of four weft insertion cycles (a, b, c, d) each time during two successive weft insertion cycles one weft yarn (1) being inserted (a, b) under the two levels (N1, N2) and one weft yarn (1) being inserted above the two levels (N1, N2) and each time, during two other successive weft insertion cycles (c, d) one weft yarn (1) being inserted in each of these weft insertion cycles between the said levels (N1, N2).

21 Claims, 3 Drawing Sheets

U.S. PATENT DOCUMENTS

| | | | | |
|---|---|---|---|---|
| 6,186,189 | B1 * | 2/2001 | Gheysen | 139/392 |
| 6,273,148 | B1 * | 8/2001 | Debaes et al. | 139/402 |
| 6,289,941 | B1 * | 9/2001 | Debaes | 139/402 |
| 6,336,475 | B2 * | 1/2002 | Dewispelaere et al. | 139/391 |
| 6,343,626 | B1 * | 2/2002 | Demey et al. | 139/398 |
| 6,457,489 | B2 * | 10/2002 | Smissaert | 139/21 |
| 6,502,605 | B2 * | 1/2003 | Goessl et al. | 139/21 |
| 6,817,383 | B2 * | 11/2004 | Debaes et al. | 139/21 |
| 6,837,274 | B2 * | 1/2005 | Debaes et al. | 139/21 |
| 6,945,280 | B2 * | 9/2005 | Debaes | 139/21 |
| 2001/0010236 | A1 * | 8/2001 | Dewispelaere et al. | 139/391 |
| 2001/0050112 | A1 * | 12/2001 | Smissaert | 139/383 A |
| 2002/0036021 | A1 * | 3/2002 | Goessl et al. | 139/2 |
| 2003/0226613 | A1 * | 12/2003 | Debaes et al. | 139/408 |
| 2004/0084101 | A1 * | 5/2004 | Debaes | 139/2 |
| 2004/0221915 | A1 * | 11/2004 | Debaes et al. | 139/409 |

FOREIGN PATENT DOCUMENTS

| | | |
|---|---|---|
| EP | 1052318 | 11/2000 |
| EP | 1347086 | 9/2003 |

* cited by examiner

METHOD FOR MANUFACTURING HIGH DENSITY PILE FABRICS

This application claims the benefit of Belgian Application No. 2005/0591 filed Dec. 6, 2005, which is hereby incorporated by reference in its entirety.

BACKGROUND OF THE INVENTION

The present invention relates to a method for manufacturing face-to-face woven pile fabrics, two backing fabrics being woven above one another on a weaving machine by inserting weft yarns in successive weft insertion cycles between binding and tension warp yarns, the pile warp yarns forming a pile in at least one part of the pile fabric by being alternately interlaced around a weft yarn in the upper backing fabric and around a weft yarn in the lower backing fabric and pile warp yarns forming no pile in at least another part of the pile fabric and being interlaced in one of the backing fabrics in accordance with a predetermined pattern. More particularly, the present invention is relating to a high density pile fabric manufactured in accordance with the present method.

Furthermore, the present invention relates to a weaving machine provided for the method according to the invention to be carried out.

Hand-knotted fabrics are characterized by:

a high density;

a delicate design in many colours (six colours and more);

a nice back.

When weaving there is an evolution to systematically increase the density of pile fabrics. Where in weaving, the weaving reed used to be a restriction for densities above 550 pile warp yarns per metre, because the number of reed dents per metre was restricted to 550, the European patent publication EP 1 347 086 proposes a method for the densities of a pile fabric to be increased by providing two pile warp systems per reed dent in combination with a suitable arrangement of the backing warp yarns in this reed dent in order to realize a certain separation between the pile warp yarns of the two pile warp systems within the same reed dent.

In this manner, it will be possible to produce fabrics having 700 and even 800 pile warp systems per metre in the weft direction. It is possible to apply this method with 1/1 V-weave as represented in EP 1 347 086 on a double rapier weaving machine, the pattern forming pile warp yarn being interlaced alternately in each fabric around a weft at the back of the fabric and then around a weft on the pile face of the fabric.

With this method therefore, only half the pile will be interlaced around a weft at the back of the fabric, so that the other half of the pile will be interlaced less securely on the pile face of the said fabric, which may be deduced immediately from the pattern which will be observed at the back of the fabric. This pattern will contain only half of the pile points and therefore is less delicate than the pattern at the front of the fabric.

In a 1/2 V-weave all pile warp yarns are indeed interlaced around a weft at the back of the fabric. Here, the pile warp yarns being interlaced securely, which is clearly shown by the pattern at the back of the carpet. The pattern at the back clearly corresponds to the pattern at the front, because of which, a quality may be approached which will be better in accordance with a hand-knotted carpet than the one of a 1/1 V-weave which is not fully interlaced through to the back of the fabric.

Only, when weaving the 1/2 V texture by means of the multiple rapier technique, the problem may occur that mixed contours are produced, preventing delicate designs from being formed, which is rather inconvenient in fabrics of this density.

Mixed contour mean that two pile tufts of a different pile warp yarn (colour) will occur between two successive wefts in a face-to-face fabric, which will be crossing and standing upright next to one another in a face-to-face fabric. Because the two pile tufts are crossing with this colour change, they will take up a wrong position with respect to one another in accordance with what is desired and this will cause the pattern of the fabric to become indistinct.

It is known that certain mixed contours may occur in one of the fabrics or in both fabrics at certain colour (pile warp yarn) changes, dependent on the positions taken up by the yarns of these changing pile warp yarns when they are not forming the pattern and are interlaced as dead pile. Thus:

when the pile change occurs from a pile warp yarn being interlaced as a dead pile in the upper fabric, to a pile warp yarn being interlaced in the lower fabric, a mixed contour will never be produced;

when the pile change occurs from a pile warp yarn being interlaced as a dead pile in the upper fabric, to a pile warp yarn being interlaced in the upper fabric, a mixed contour will be produced in the upper fabric;

when the pile change occurs from a pile warp yarn being interlaced as a dead pile in the lower fabric, to a pile warp yarn being interlaced in the lower fabric, a mixed contour will be produced in the lower fabric;

when the pile change occurs from a pile warp yarn being interlaced as a dead pile in the lower fabric, to a pile warp yarn being interlaced in the upper fabric, a mixed contour will be produced in both fabrics;

Such mixed contour effects may be avoided by providing two lines of the same colour (the same pile warp yarn) in the card design after one another and to apply to them the method described in the European patent publication EP 9 27782 and, of at least one of the pile warp yarns involved in the pile change, one lift plan before the pile change or one lift plan after the pile change being replaced by a correction lift plan.

In practice, such correction lift plans may be applied automatically to the processing software transforming the design into a file in order to activate the Jacquard machine. However, in order to be able to apply this method, a number of rules have to be respected as indicated when setting up the design, namely that the correction lift plan may only be applied to produce the effect expected, when during two successive pile plans the pile is formed by one and the same pile warp yarn.

In the very delicate patterns to be woven by means of the devices as described above, applying these applications to the design is very labour intensive. Moreover, the liberty of designing in delicate drawings will be restricted.

Moreover, the fact of mixed contours occurring or not, depends on the position of the pile warp yarns in the weaving creel, for the position of the pile warp yarns will determine in which fabric the pile will be interlaced.

Although, from a technical point of view, it is possible to avoid mixed contours, we find that in practice, quite some fabrics are still showing mixed contours. Moreover the delicate designing requires (typical of fabrics imitating hand-knotted carpets) a freedom of designing, which is not always to be realized by avoiding mixed contours as described above. Double colour rows in order to avoid mixed contours are sometimes inconvenient to the delicacy of a design.

The 1/1V method and the 1/2V method as described before, moreover, have the disadvantage that they are restricted to about 40 pile warp yarns per centimetre with double rapier weaving machines which are normally used.

At higher densities of pile warp yarns, there will be problems as to the perfectness of the quality of the back and the dead pile protruding from the back of the fabric. This certainly is the case with acrylic and woolen yarns having a surface which is more coarse. With polypropylene yarns also, which are smoother, these problems will occur, but in that case rather from 42 to 45 pile warp yarns per centimetre.

This means, that a fabric having a high density and many colours will cause problems to be woven, both with a 1/1V and 1/2V weave, on a double rapier weaving machine in the following structures:

600 pile warp systems per metre in 7 chore and more:

700 pile warp systems per metre in 6 chore and more:

800 pile warp systems per metre in 5 chore and more.

SUMMARY OF THE INVENTION

The purpose of this invention consists in providing a method to weave a high density pile fabric, without mixed contours, without the need of the design to be adapted and, moreover, a nice back being realized.

The purpose of the invention is attained by providing a method for the face-to-face weaving of a pile fabric, two backing fabrics, one above the other, being woven on a weaving machine, by inserting weft yarns in successive weft insertions cycles between binding and tension warp yarns, pile warp yarns forming the pile in at least one part of the pile fabric by interlacing alternately around a weft yarn in the upper backing fabric and around a weft yarn in the lower backing fabric and pile warp yarns not forming a pile in at least one other part of the pile fabric and being interlaced in one of the backing fabrics in accordance with a predetermined pattern, the said weaving machines comprising at least three weft insertion means and only one weft yarn being inserted in each weft insertion cycle, the non pile forming pile warp yarns being positioned to be interlaced in the upper fabric, and the non pile forming pile warp yarns to be interlaced in the lower fabric being positioned each on a different level and, in successive series of four weft insertion cycles, each time during two successive weft insertion cycles, one weft yarn being inserted below the two levels and one weft yarn being inserted above both levels and each time during two other successive weft insertion cycles, one weft yarn being inserted between the said levels in each of these weft insertion cycles.

The expert skilled in the art knows that mixed contours may be avoided when weaving pile fabrics by inserting only one weft into the fabric at each weft insertion cycle. This method is known for use on a face-to-face weaving machine having only one weft insertion means (single gripper weaving machine).

As these devices for face-to-face weaving of pile fabrics are no longer manufactured, these methods are applied to double gripper weaving machines, where either at each weft insertion cycle, either one of the weft insertion means is disengaged or no weft yarn will be presented to one of the weft insertion means.

Applying these methods to pile fabrics with densities the number of pile warp yarns per centimetre exceeding 40, has the disadvantage that the weaving process will cause great difficulties accompanied by a large number of disturbances. Moreover, the quality of the fabric produced will be inferior, the back of the fabric is not a nice one, because (dead) non pile forming pile warp yarns will be visibly protruding in certain places from the back of the fabric. As the density of the fabric in the weft direction will be increasing and the number of colours (pile warp yarns) being used is likewise increasing, this problem will become only bigger.

After thorough research into the causes of this problem it has been found that, when manufacturing such fabrics, an enormous package of pile warp yarns is found which are extending in the weft direction practically next to one another (=number of pile warp yarn systems×number of chores). A Jacquard machine will position these pile warp yarns at each weft insertion cycle with respect to the weft insertion means. At such densities of pile warp yarns, changing the position of these mass of pile warp yarns with respect to the weft insertion means is a complicated operation with a Jacquard machine. On the one hand, there is the heavy load on the Jacquard machine necessary to move this mass of non pile forming pile warp yarns. On the other hand these non pile forming pile warp yarns will be moving only relatively slightly with respect to one another, but yet this relatively slight motion of the non pile forming yarns with respect to one another means that uncontrollable forces and tensions will occur, among others because of the yarns becoming entangled and the consumption of the separate pile warp yarns being increased. Thus, it will be impossible to predict exactly which yarn will be moving, when and along which distance. Because of this, these non pile forming pile warp yarns will be irregularly interlaced during the formation of the fabric, so that the fabric will show an imperfect aspect (this will be noted essentially at the back of the fabric).

The solution to this problem consist in choosing the manufacture of such high density fabrics on a face-to-face-weaving machine with three weft insertion means, only one of the three weft insertion means inserting a weft at each weft insertion cycle, whereas either the other weft insertion means do not extend through the shed or do not take along any weft yarns when moving through the shed. With this method it is possible to insert the wefts in both fabrics, above between or below the levels of the non pattern forming pile warp yarns, the non pattern forming pile warp yarns being interlaced in the upper fabric situated on a first level and the non pattern forming pile warp yarns in the lower fabric on a second level.

By this method it is possible to manufacture high density pile fabrics without mixed contours occurring.

In a particular method according to the invention, pile forming pile warp yarns are interlaced only around weft yarns having been inserted below or above the two levels at which non pile forming pile warp yarns are positioned to be interlaced in their backing fabrics.

In a preferred method according to the invention, the non pile forming pile warp yarns to be interlaced in the upper fabric and the non pile forming pile warp yarns to be interlaced in the lower fabric will maintain their positions with respect to the weft insertion means during the non pile formation. This has the great advantage that the non pile forming pile warp yarns which are interlaced in the upper fabric, will maintain their positions between the upper and the central weft insertion means and that the non pile forming pile warp yarns which are interlaced in the lower fabric will maintain their positions between the central and the lower weft insertion means. In this manner, only the pile forming pile warp yarns will have to be moved out of or through the bundle of pile warp yarns. This manner very strongly favours the forming of the shed at higher densities of pile warp yarns and will finally lead to a lower consumption of pile warp yarns.

In a more particular method according to the invention the pile warp yarns are inserted in series of four successive weft insertion cycles, each time one weft yarn, around which a pile forming warp yarn is interlaced, being inserted in the first two weft insertion cycles in each of the fabrics, with for the upper fabric the upper weft insertion means and for the lower fabric the lower weft insertion means and that in the third and fourth weft insertion cycles of the said series, into each of the fabrics, each time one weft yarn is inserted between the said levels by means of the central weft insertion means.

In a preferred embodiment of the method according to the invention, during the successive weft insertion cycles of the said series, one weft yarn is inserted alternately in order to form the upper fabric and one weft yarn in order to form the lower fabric or vice versa.

In a more preferred method according to the invention, one weft yarn is inserted in the first weft insertion cycle by means of the lower weft insertion means under the said levels, in the second weft insertion cycle, one weft yarn is inserted by mean of the upper weft insertion means above the said levels, in the third and fourth weft insertion cycles, successively one weft yarn is inserted each time by means of the central weft insertion means, on the pile face of the upper and lower fabric respectively.

In another embodiment of the method according to the invention, in the first weft insertion cycle, one weft yarn is inserted under the said levels by means of the lower weft insertion means, in the second weft insertion cycle, one weft yarn is inserted above the said levels by means of the upper weft insertion means and in the third and fourth weft insertion cycles, each time one weft yarn is inserted successively by means of the central weft insertion means on the pile face of the lower and upper fabric respectively.

In a more preferred method according to the invention, one weft yarn is inserted in the first weft insertion cycle by means of the upper weft insertion means above the said levels, in the second weft insertion cycle, one weft yarn is inserted by means of the lower weft insertion means under the said levels and in the third and fourth weft insertion cycles, one weft yarn is inserted successively each time by means of the central weft insertion means, on the pile face of the upper and lower fabric respectively.

In a preferred embodiment of the method according to the invention, one weft yarn is inserted in the first weft insertion cycle by means of the upper weft insertion means above the said levels, in the second weft insertion cycle one weft yarn is inserted by means of the lower weft insertion means under the said levels and in the third and fourth weft insertion cycles, one weft yarn is inserted successively each time by means of the central weft insertion means, on the pile face of the lower and upper fabric respectively.

In a more particular embodiment of the method according to the invention, a first and a second pile warp yarn are performing a pile change, the second pile warp yarn becoming pile forming by, after the fourth weft insertion cycle of a series, being interlaced in a pile forming manner around a weft yarn inserted during the first weft insertion cycle of a next series at the back of the backing fabric and the first pile warp yarn stopping to form the pile by interlacing the said first pile warp yarn after the second weft insertion cycle of the series, in its backing fabric without forming a pile. This means that in both fabrics the pile tufts of adjacent pile burls are separated, each time, by an intermediate weft, because of which there is no possibility for the adjacent pile burls to cross one another and no mixed contours will occur. A fine delicate design is obtained on the pile face of the fabric, whereas all pattern forming pile is interlaced at the back of the fabric, so that a nice pattern is formed also at the back of the fabric.

In a further preferred embodiment of the method according to the invention, during at least one series of four successive weft insertion cycles, pile forming pile warp yarns are interlaced around each weft yarn inserted during the series.

If a same pile warp yarn is interlaced around the four successive wefts of a series, pile tufts of different adjacent pile burls will indeed be found without being separated by a weft yarn, but this wefts are not crossing in the face-to-face fabric, so that there will be no mixed contour. The two pile tufts of the same colour are standing nicely upright next to one another and they will also maintain this position in the fabric. This means that the pile density of the fabric in part of the fabric or almost the entire fabric may be increased without mixed contours occurring and with preservation of a delicate design and a nice back of the fabric.

In a more particular method according to the invention, the tension warp yarns of the upper and lower fabric are positioned outside the upper and lower weft insertion means respectively, each time no weft yarn is inserted at the back of the respective fabric and the tension warp yarns of the upper and lower fabric are positioned between the upper and the lower weft insertion means respectively and the central weft insertion means being positioned, each time a weft yarn is inserted at the back of the respective fabric. This has, among others, the advantage that the tension warp yarn in the lower fabric is used as a support for the lower weft insertion means when it is moving through the shed without a weft yarn.

High densities of warp yarns in the weft direction are realized by a combination of a large number of warp yarn systems per metre and a large number of chores. The large number of warp systems per metre is obtained, by providing at least two pile warp systems per reed dent, in a particularly advantageous embodiment of the method according to the invention. This has the great advantage that by using this method, fabrics having a high density, more particularly of more than 40 pile warp yarns per centimetre, may be manufactured, without mixed contours occurring.

In a preferred embodiment of the method according to the invention, the said weaving machine is provided, either for disengaging at least one weft insertion means or/and for not presenting a weft yarn to at least one weft insertion means.

In a more preferred embodiment of the method according to the invention, the weft insertion means are provided with a driving device in order to carry the weft insertion means through the shed and the weaving machine is provided for selecting any weft insertion means, during each cycle, whether a weft insertion means will be carried through the fabric or not by connecting or disconnecting the respective weft insertion means to or from its driving device.

More particularly connecting or disconnecting the weft insertion means to or from its driving device may occur in an electromotive, electropneumatic or electrohydraulic manner.

Furthermore, the present invention relates to a weaving machine for weaving a face-to-face fabric comprising binding and tension warp yarns, weft yarns and at least 40 pile warp yarns per centimetre which, in at least one part of the fabric, are interlaced alternately in the upper and lower backing fabric, forming a pile around a weft yarn and which, at least in one other part of the fabric are interlaced, not forming a pile, in one of the backing fabrics, the said weaving machine comprising three weft insertion means and being provided for inserting only one weft yarn at each weft insertion cycle, the pile warp yarns not forming the pile before being interlaced in the upper fabric and the pile warp yarns not forming the pile before being interlaced in the lower fabric, each being positioned on a different level and where in successive series of four weft insertion cycles, each time, one weft yarn is inserted under both levels during two successive weft insertion cycles and one weft yarn being inserted above both levels and each time, during two other successive weft insertion cycles, in each of these weft insertion cycles, one weft yarn is inserted between the said levels.

In a particularly preferred embodiment of the weaving machine according to the invention, the said weaving machine is a face-to-face three rapier weaving machine provided with a non-open shed Jacquard machine.

In another particularly preferred embodiment of the weaving machine according to the invention, the said weaving machine is a face-to-face three rapier weaving machine provided with an open shed Jacquard machine.

In the following detailed description of the method according to the present invention the said particulars and advantages of the invention are further explained. It may be obvious that the only intention of this description exists in clarifying the general principles of the present invention by a concrete example, and that nothing of this description may be interpreted as being a restriction of the scope of the patent rights demanded for in the claims nor of the field of application of the present invention.

BRIEF DESCRIPTION OF THE DRAWINGS

In the following description, by means of reference numbers, reference is made to the attached figures of which.

DETAILED DESCRIPTION OF THE PREFERRED EMBODIMENTS

Figure 1A:
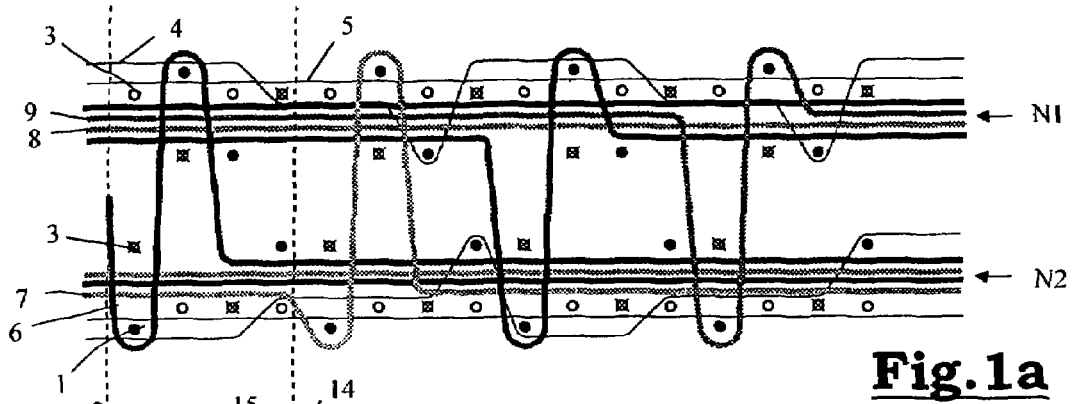
FIG. 1 is representing a method according to the invention in accordance with a 1/2V-weave.
Figure 1B:
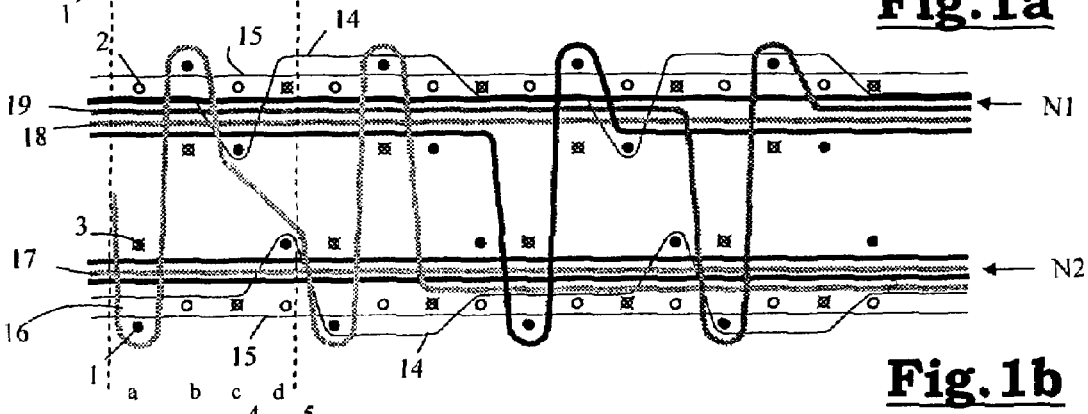
Figure 1C:
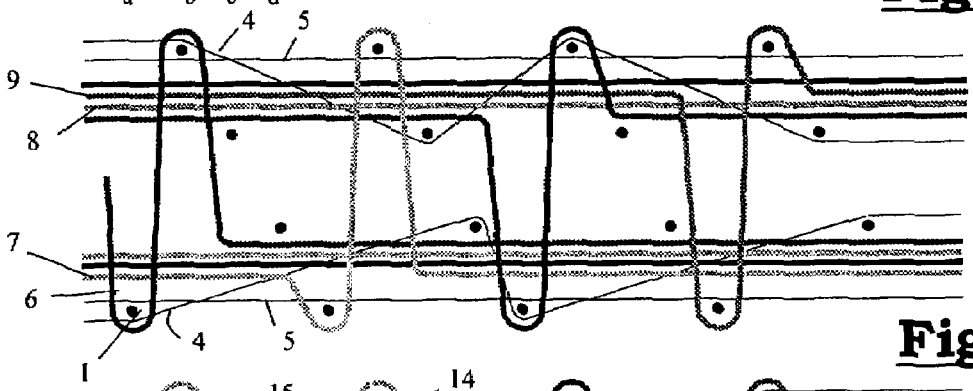
Figure 1D:
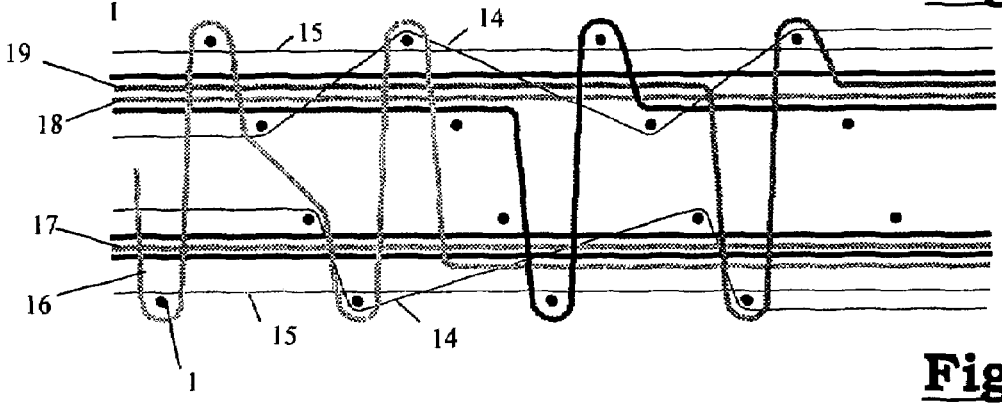

The face-to-face pile fabric represented in the figures consists of an upper an a lower backing fabric. Both backing fabrics consist of binding warp yarns, tension warp yarns and weft yarns. Pile forming pile warp yarns are alternately interlaced in the upper and the lower fabric around a weft yarn, whereas non pile forming (dead) pile warp yarns are interlaced in the upper or the lower backing fabric and each of which is positioned on a different level (N1, N2).

Each figure is made up of four parts (a), (b), (c) and (d), where (a) is representing the course of the pile warp yarns (6, 7, 8, 9) of one pile warp system within one reed dent with the accessory part of the backing warp yarns (4, 5) and (b), the pile warp yarns (16, 17, 18, 19) of another pile warp system within the same reed dent with its accessory backing warp yarns (14, 15). Both in (a) and in (b) the positions of the weft insertion means are indicated with respect to the warp yarns and is indicated with which weft insertion means a weft yarn (1) is indeed inserted (little balls in black colour). The little balls (2) in white colour are representing the level of the weft insertion, where the weft insertion means is not carried through the shed. The little cross-marked balls (3) are representing a weft insertion means level where the weft insertion means is carried through the shed without carrying a weft yarn (1). Indication of the little white balls (2) and the little cross-marked balls (3) within the figures is only by way of example of a combination of the various possibilities to carry no weft yarn (1) through the shed. Any random combination of succession or variation of one of these or other possibilities to carry no weft yarn (1) through the shed likewise falls within the scope of the present invention.

The figures (c) and (d) are representing the actual texture of the fabric which is realized with the weft yarns (1) which are actually inserted with the pile warp system represented in (a) and (b) respectively.

In correspondence with the method according to the invention, two backing fabrics are woven one above the other on a weaving machine comprising at least three weft insertion means and only one weft yarn (1) being inserted at each weft insertion cycle (a, b, c, d), the non pile forming pile warp yarns to be interlaced in the upper fabric and the non pile forming pile warp yarns to be interlaced in the lower fabric each being positioned on a different level (N1, N2) and in successive series of four weft insertion cycles (a, b, c, d,) each time during two successive weft insertion cycles (a, b) one weft yarn (1) being inserted under the two levels (N1, N2) and one weft yarn (1) being inserted above the two levels (N1, N2) and each time during two other successive weft insertion cycles (c, d) one weft yarn (1) being inserted in each of these weft insertion cycles between the said levels (N1, N2).

By using a three rapier machine, it will be possible for the pile warp yarns which are not pile forming and which are interlaced at level (N1) in the upper fabric two maintain their positions between the upper and the central weft insertion means. The non pile forming warp yarns which are interlaced in the lower fabric on level N2, will maintain their positions between the central and the lower weft insertion means, Therefore, instead of moving the dead pile with respect to one of the weft insertion means, inserting successive wefts into a backing fabric (as is the case when weaving on a face-to-face single or double gripper weaving machine), each time the weft insertion means may be selected which, with respect to the stationary non pile forming pile, will insert the right weft yarn in order to obtain the weave structure desired. In this manner, only the pile warp yarns forming the pile have to be moved out of or through the bundle of pile warp yarns.

This method will strongly favour the forming of the shed for weaving pile fabrics having a high density of pile warp yarns and will ultimately lead to a lower consumption of pile warp yarns. With coarse pile warp yarns, such as for instance woolen and acrylic yarns, this favourable effect is important in order to weave fabrics having more than 40 pile warp yarns per centimetre in the weft direction. But also with the smoother yarns of polypropylene such a method is offering a real advantage with respect to the fabric being neat and clean at densities as from 45 pile warp yarns per centimetre in the weft direction.

The method has the advantage that the course of the yarn will become smoother and the consumption of pile warp yarn will be reduced, so that it will be possible to insert more wefts and more pile rows per centimetre in the warp direction and will lead to achieve a much cleaner pattern on the back of the carpet, because the dead pile have a still lower tendency to protrude from the backing fabric.

In FIG. 1, a method and a fabric according to the invention are represented, a weft yarn (1) actually being carried through the shed in successive series of four weft insertion cycles (a, b, c, d), in the first cycle (a) only by means of the lower weft insertion means, in the second cycle (b) a weft yarn (1) being actually carried through the shed only by means of the upper weft insertion means, and in the third (c) and fourth (d) cycles each time a weft yarn (1) is actually carried through the shed only by means of the central weft insertion means.

The pile forming pile warp yarn (6, 7, 8, 9, 16, 17, 18, 19) is interlaced alternately around the weft (1) inserted under the two levels (N1, N2) at the back of the lower fabric, in the first cycle (a) and around the weft (1) inserted above the two levels (N1, N2) at the back of the upper fabric in the second cycle (b). The said pile forming pile warp yarn remains in the third (c) and fourth (d) cycles respectively under and above the wefts (1), which are inserted by means of the central weft insertion means between the two levels (N1, N2). In this manner the pile is formed in a 1/2V-weave. A pile forming pile warp yarn (6, 7, 8, 9, 16, 17, 18, 19) which is stopping its pile formation and will be interlaced in the upper fabric as a dead pile will, is moving, after being interlaced in the second weft insertion cycle (b) of a series around the weft (1) in the upper fabric above the central rapier, and will further remain in a position (N1) between the central and the upper weft insertion means until the yarn will become pile forming again.

A pile forming pile warp yarn (6, 7, 8, 9, 16, 17, 18, 19), which is stopping its pile formation and will be interlaced in the lower fabric as a dead pile will, is moving after being interlaced in the second weft insertion cycle (b) of a series around the weft (1) in the upper fabric under the central rapier and will further remain in a position (N2) between the central and the lower weft insertion means until the yarn will become pile forming again.

It may be noticed that the wording that the pile warp yarn which is stopping to form a pile is taking up a position above or under the central weft insertion means, in this third (c) weft insertion cycle, means that as no weft is inserted by the outermost weft insertion means, this pile warp yarn may take up a position also above the upper or under the lower weft insertion means respectively, instead of taking up a position between the central and the outermost weft insertion means. The result in the fabric will be the same as pattern forming on the pile face and at the back is concerned.

A pile forming pile warp yarn (6, 7, 8, 9, 16, 17, 18, 19) which is interlaced as a dead pile in the upper or lower fabric respectively is moving, when it becomes pile forming, after the fourth weft insertion cycle (d) of a series, from its position above or under the central rapier respectively, to a position under the weft (1) inserted by the lower gripper in a first weft insertion cycle (a) of a new series.

In this manner a fabric is obtained, each pile tuft being separated from an adjacent pile tuft by the presence of a weft yarn (1) and no crossings of pile warp yarns situated next to one another will occur. This means that there will be no mixed contours and a clear pattern will be formed on the pile face. The non pile forming (dead) pile warp yarns (6, 7, 8, 9, 16, 17, 18, 19) interlaced in the upper fabric will maintain their positions (N1) between the central and the upper weft insertion means without moving. The non pile forming (dead) pile warp yarns (6, 7, 8, 9, 16, 17, 18, 19) interlaced in the lower fabric will maintain their positions (N2) between the central and the lower weft insertion means without moving. Due to this the mass of non pile forming pile warp yarns will remain well in position (N1, N2) and well tensioned, so that a clean back with a clear formation of the pattern is realized. Furthermore, due to this, the consumption of pile warp yarns as dead piles will be restricted, which in turn will enable more wefts and pile rows per centimetre to be inserted into the fabric.

Figure 2A:
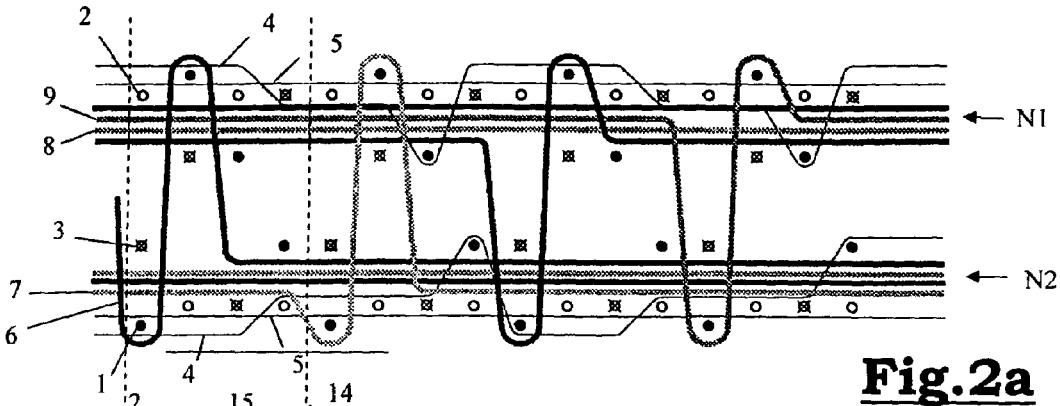
FIG. 2 is representing a method according to the invention in accordance with a 1/2V-weave, in which locally also a 2/2V-weave is realized.
Figure 2B:
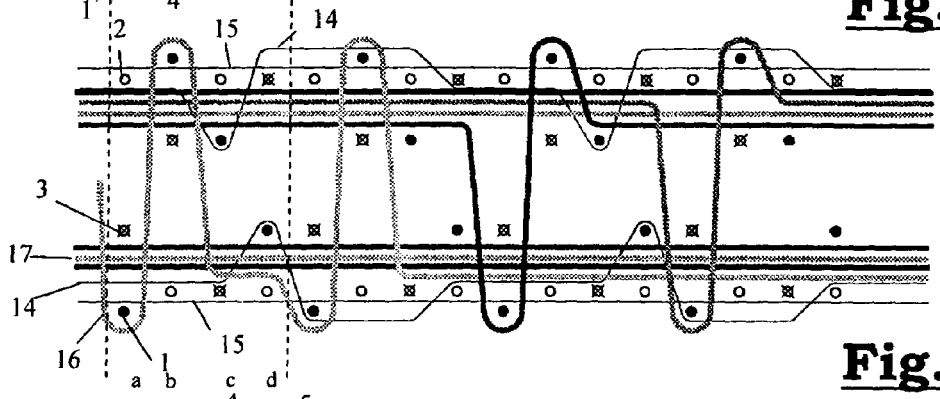
Figure 2C:
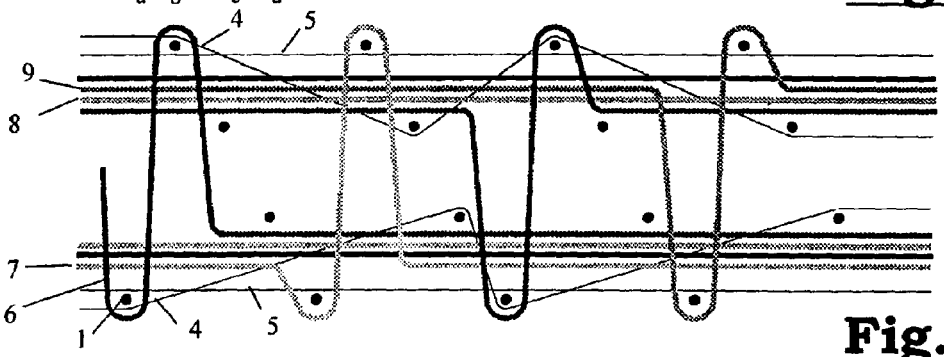
Figure 2D:
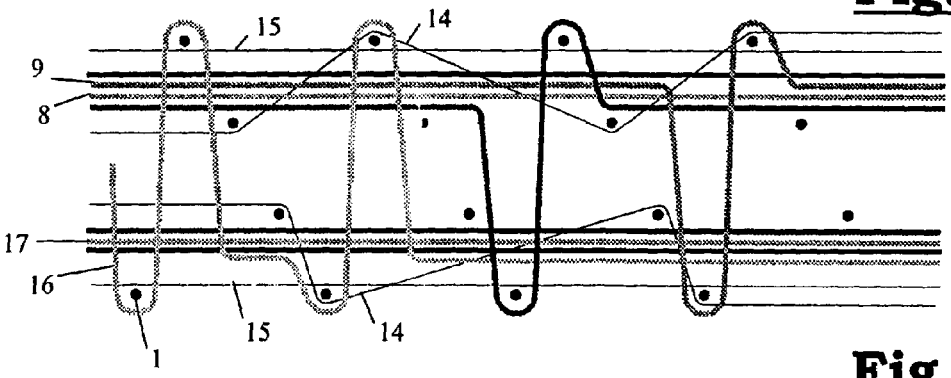
Figure 3A:
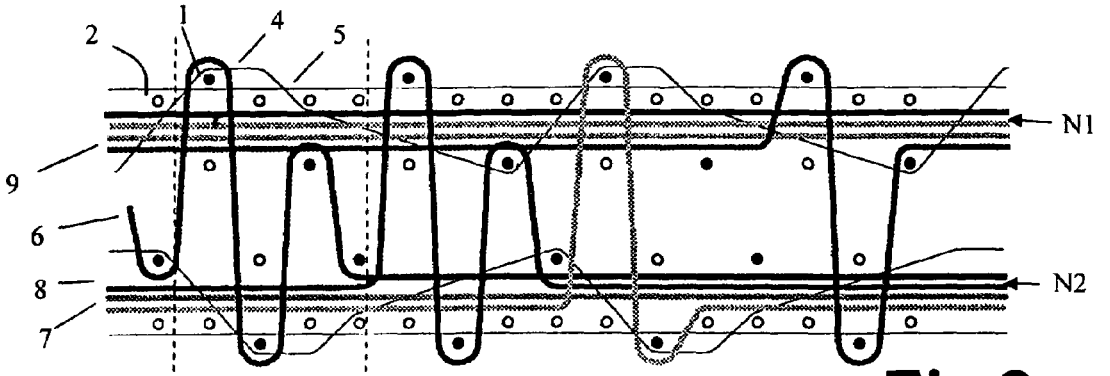
FIG. 3 is representing a method according to the invention in accordance with a 1/2V-weave, in which locally also a 1/1V-weave is realized.
Figure 3B:
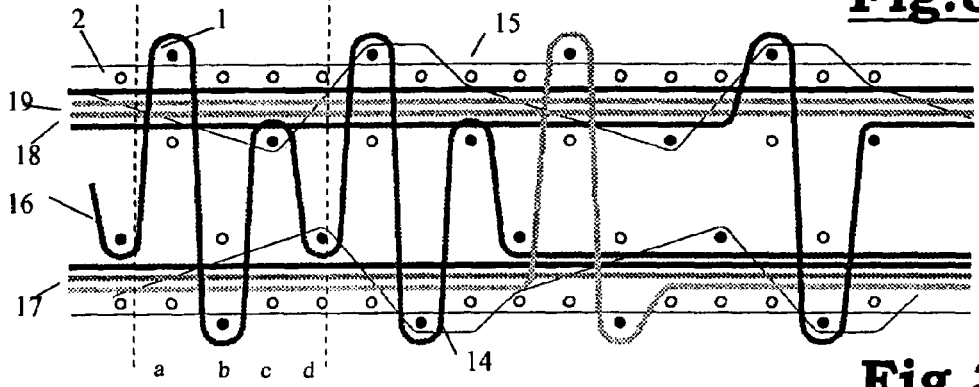
Figure 3C:
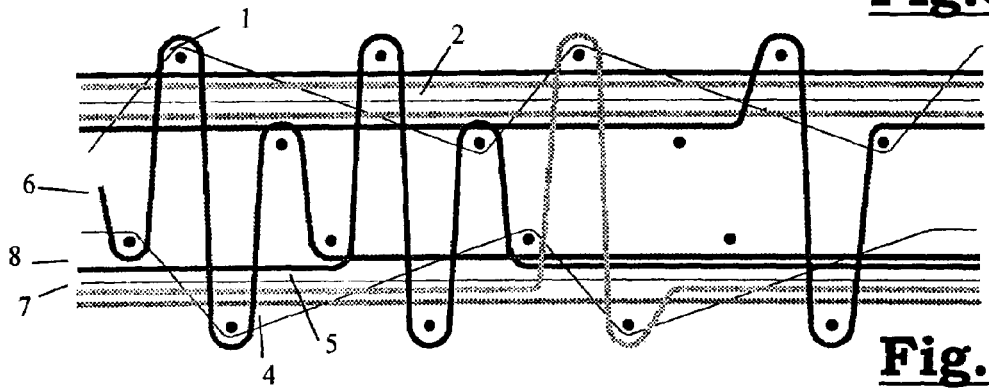
Figure 3D:
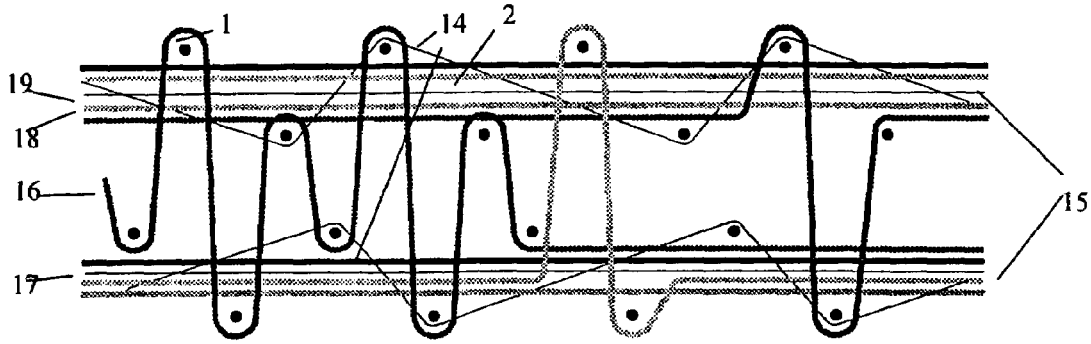

In order to realize even higher densities it is possible, in areas where no pile changes will occur between pile forming pile warp yarns, to choose in order, as represented in the FIGS. 2*b* and 2*d*, to position the pile forming pile warp yarns in the fourth weft insertion cycle (d) of a series, under the weft yarn inserted by the central gripper, so that a local 2/2-V texture is formed in the lower fabric by which a higher density is realized locally.

It is likewise possible (not represented in the figure) to position the pile forming pile warp yarns in the third cycle (c) above the central weft insertion means, so that both in the lower and in the upper fabric this higher density may be realized. Such local increases of density of the weave structure may be determined, for example, when setting up the operating programme of the Jacquard machine on the basis of the fabric design in order to maintain a constant density of the fabric in the entire fabric.

In the FIGS. 3 *a, b, c, d* a weave structure is represented in which, on the one hand, the actual weft insertion order is different from the texture represented in FIG. 1, because the first weft (a) of a series of four wefts (a, b, c, d) is now a weft yarn which is inserted into the upper fabric with respect to the tension warp yarn at the back and that the second weft (b) of a series of four wefts is a weft yarn which is inserted into the lower fabric, at the back with respect to the tension warp yarn.

Furthermore, in FIG. 3, between their start as a pile forming pile warp yarn in a first cycle (a) of a series of four weft insertion cycles (a, b, c, d) and their stopping as a pile forming pile warp yarn in a second cycle (b) of a further series of weft insertion cycles (a, b, c, d) pile warp yarns (6) are also interlaced around one or several wefts inserted during the last two weft insertion cycles (c, d) of one or several series (a, b, c, d), so that the pile density may be locally increased. The pile tufts of different colours thus becoming positioned next to one another and will not be separated by a weft yarn are not crossing in the face-to-face fabric so that no mixed contour will occur.

When in two adjacent pile warp systems within one reed dent some colours of pile warp yarns will be made different, then when selecting one of these colours in view to form the pile, only half the density in the weft direction will be realized with respect to the pile formation of pile warp yarns which are actually indeed present in each of the pile warp systems. It is possible to almost compensate for this halving of the pile density by, for instance, also by interlacing in the weft direction around the wefts situated on the pile face of the tension warp yarn. In this manner, it will be possible to increase the number of chores in the fabric, practically maintaining the pile density and it still being possible to avoid mixed contours.

According to the present invention, the weaving machine is equipped so that all the weft insertion means in order to apply the method according to the invention are able to select, in every cycle (a, b, c, d), whether a weft insertion means will be carried through the shed or not. This is possible by connecting or disconnecting the weft insertion means to or from its driving device in an electromotive, electropneumatic or electrohydraulic manner in order to carry it through the shed. In this case, departing from the weaving pattern and the weave structure, it will be possible to set up a programme, enabling the controller of the Jacquard machine to activate any connecting device of a drive with its weft insertion device in any machine cycle (a, b, c, d) in order to realize the fabric desired.

Fabrics according to the invention, such as represented in FIG. 1, for instance, may be woven by means of a face-to-face three rapier weaving machine provided with a Jacquard machine, functioning in accordance with the non open shed principle, as described in the European patent publication EP 627511, as this Jacquard machine will enable the pile warp yarn either to be maintained in a position (N1) between the upper and the central rapier or in a position (N2) between the lower and the central rapier, as well as to form the pile from these positions. It will be obvious that the method according to the invention is likewise applicable using a face-to-face three rapier weaving machine provided with an open shed Jacquard machine.

It is known that fabrics according to a 2/2V-weave, in which each pile tuft in a fabric is surrounding two wefts, will enable the density of the fabric to be increased. In the method of the invention, this is not generally applicable, because this would mean that when passing from a pile forming pile warp yarn to a second pile forming pile warp yarn, two pile tufts will become positioned next to one another which are not separated from one another by a weft and are crossing, causing mixed contours to occur, which is just what we want to avoid by the method according to the invention.

A method which indeed may be actually applied in order to increase the density of the fabric without causing mixed contours, consists in interlacing the pile warp yarn indeed around two wefts in places where no colour change in the weft direction occurs and not to do this where there is a colour change.

The processing software for transforming the pattern of a fabric into a programme to activate a Jacquard machine, will be able to distribute such transitions uniformly all over the fabric in order to obtain a uniformly woven fabric. By a uniform distribution is meant that during a number of machine cycles practically the same number of pile tufts is interlaced around two wefts in each pile warp system.

The invention claimed is:

1. Method for manufacturing face-to-face woven pile fabrics, two backing fabrics being woven above one another on a weaving machine by inserting weft yarns in successive weft insertion cycles (a, b, c, d) between binding and tension warp yarns (4, 5, 14, 15), the pile warp yarns forming a pile in at least part of the pile fabric by being interlaced alternately around a weft yarn (1) in the upper fabric and around a weft yarn (1) in the lower fabric and the pile warp yarns forming no pile in at least another part of the pile fabric and being interlaced in one of the backing fabrics in accordance with a predetermined pattern, characterized in that the said weaving machine comprises at least three weft insertion means and in that only one weft yarn (1) is inserted at each weft insertion cycle, the non pile forming pile warp yarn to be interlaced in the upper fabric and the non pile forming pile warp yarns to be interlaced in the lower fabric are each positioned on a different level (N1, N2) and in successive series of four weft insertion cycles (a, b, c, d), each time during two successive weft insertion cycles (a, b) one weft yarn (1) being inserted under the two levels (N1, N2) and one weft yarn (1) being inserted above the two levels (N1, N2) and each time during two other successive weft insertion cycles (c, d), one weft yarn (1), in each of these weft insertion cycles being inserted between the said levels (N1, N2).

2. Method according to claim 1, characterized in that pile forming pile warp yarns are interlaced only around weft yarns having been inserted below or above the two levels (N1, N2) at which non pile forming pile warp yarns are positioned to be interlaced in their backing fabrics.

3. Method according to claim 1, characterized in that the non pile forming pile warp yarns to be interlaced in the upper fabric, and the non pile forming pile warp yarns to be interlaced in the lower fabric, during the non pile formation, will maintain their positions with respect to the weft insertion means.

4. Method according to claim 1, characterized in that the weft yarns (1) are inserted in series of four successive weft insertion cycles (a, b, c, d), in the first two weft insertion cycles (a, b) in each of the fabrics, one weft yarn (1) being inserted around which a pile forming pile warp yarn is interlaced by means of the upper weft insertion means for the upper fabric and by means of the lower weft insertion means for the lower fabric and in that in the third and fourth weft insertion cycles (c, d) of the said series, each time, one weft yarn (1) being inserted between the said levels (N1, N2) by means of the central weft insertion means.

5. Method according to claim 1, characterized in that during the successive weft insertion cycles (a, b, c, d) of the said series, one weft yarn (1) is inserted alternately in order to form the upper fabric and one weft yarn (1) to form the lower fabric or vice versa.

6. Method according to claim 1, characterized in that one weft yarn (1) is inserted in the first weft insertion cycle (a) by means of the lower weft insertion means under the said levels (N1, N2), one weft yarn (1) is inserted in the second weft insertion cycle (b) by means of the upper weft insertion means above the said levels (N1, N2), in the third (c) and fourth (d) weft insertion cycles each time, one weft yarn (1) is inserted successively by means of the central weft insertion means on the pile face of the upper and lower fabric respectively.

7. Method according to claim 1, characterized in that one weft yarn (1) is inserted in the first weft insertion cycle (a) by means of the lower weft insertion means under the said levels (N1, N2), one weft yarn (1) is inserted in the second weft insertion cycle (b) by means of the upper weft insertion means above the said levels (N1, N2), each time one weft yarn (1) is inserted successively in the third (c) and fourth (d) weft insertion cycles by means of the central weft insertion means on the pile face of the lower and upper fabric respectively.

8. Method according to claim 1, characterized in that one weft yarn (1) is inserted in the first weft insertion cycle (a) by means of the upper weft insertion means above the said levels (N1, N2), one weft yarn (1) is inserted in the second weft insertion cycle (b) by means of the lower weft insertion means under the said levels (N1, N2), each time, one weft yarn (1) is inserted successively in the third (c) and fourth (d) weft insertion cycles by means of the central weft insertion means on the pile face of the upper and lower fabric respectively.

9. Method according to claim 1, characterized in that one weft yarn (1) is inserted in the first weft insertion cycle (a) by means of the upper weft insertion means above the said levels (N1, N2), one weft yarn (1) is inserted in the second weft insertion cycle (b) by means of the lower weft insertion means under the said levels (N1, N2), each time, one weft yarn (1) is inserted successively in the third (c) and fourth (d) weft insertion cycles by means of the central weft insertion means on the pile face of the lower and upper fabric respectively.

10. Method according to claim 1, characterized in that a first and a second pile warp yarn will perform a pile change, the second pile warp yarn, becoming pile forming by being interlaced after the fourth weft insertion cycle (d) of a series (a, b, c, d) around a weft yarn (1) inserted during the first weft insertion cycle of a next series of weft yarns (1) inserted at the back of the backing fabric, and the first pile warp yarn stopping its formation of the pile by interlacing the said first pile warp yarn in its backing fabric not forming a pile, after the second weft insertion cycle (b) of the series (a, b, c, d).

11. Method according to claim 1, characterized in that during at least one series of four successive weft insertion cycles (a, b, c, d) the pile forming pile warp yarns are interlaced around each weft yarn (1) inserted during the series.

12. Method according to claim 1, characterized in that the tension warp yarns of the upper and the lower fabric are positioned outside the upper and lower weft insertion means respectively, each time no weft yarn (1) is inserted at the back of the respective fabric and in that the tension warp yarns of the upper and the lower fabric are positioned between the upper and the lower respectively and the central weft insertion means, each time a weft yarn (1) is inserted at the back of the respective fabric.

13. Method according to claim 1, characterized in that at least two pile warp systems (6, 7, 8, 9, 16, 17, 18, 19) are provided per reed dent.

14. Method according to claim 1, characterized in that the said weaving machine is provided either for disconnecting at least one weft insertion means and/or for not presenting a weft yarn (1) to at least one weft insertion means.

15. Method according to claim 1, characterized in that the weft insertion means are provided with a driving device in order to carry the weft insertion means through the shed, and in that the weaving machine is provided for receiving any weft insertion means in order to select during each cycle (a, b, c, d) whether a weft insertion means will be carried through the shed or not by connecting the respective weft insertion means to or by disconnecting it from its driving device.

16. Method according to claim 15, characterized in that connecting or disconnecting the weft insertion means to or from its driving device may be performed in an electromotive, electropneumatic or electrohydraulic manner.

17. Pile fabric, characterized in that said fabric will comprise at least one area which is manufactured according to a method in accordance with claim 2.

18. Weaving machine for weaving a face-to-face pile fabric comprising binding and tension warp yarns (4, 5, 14, 15), weft yarns (1) and at least 40 pile warp yarns (6, 7, 8, 9, 16, 17, 18, 19) per centimetre which in at least one part of the fabric, alternately in the upper and in the lower fabric, are interlaced, forming a pile around a weft yarn (1) and which in another part of the fabric are interlaced, not forming a pile, in one of the backing fabrics, characterized in that the said weaving machine is comprising three weft insertion means and is provided for inserting only one weft yarn (1) at each weft insertion cycle, the pile warp yarns not forming a pile to be interlaced in the upper fabric and the pile warp yarns not forming a pile to be interlaced in the lower fabric being positioned each on a different level (N1, N2) and, in successive series of four weft insertion cycles (a, b, c, d), each time during two successive weft insertion cycles (a, b), one weft yarn (1) being inserted, , under the two levels (N1, N2) and one weft yarn (1) being inserted above the two levels N1, N2) and one weft yarn (1), each time during two other successive weft insertion cycles (c, d) being inserted in each of these weft insertion cycles between the said levels (N1, N2).

19. Weaving machine according to claim 18, characterized in that pile forming pile warp yarns are interlaced only around weft yarns having been inserted below or above the two levels (N1, N2) at which non pile forming pile warp yarns are positioned to be interlaced in their backing fabrics.

20. Weaving machine according to claim 18, characterized in that said weaving machine is a three rapier face-to-face weaving machine provided with an non open shed Jacquard machine.

21. Weaving machine according to claim 18, characterized in that said weaving machine is a three rapier face-to-face weaving machine provided with an open shed Jacquard machine.

* * * * *